US007598921B2

(12) United States Patent
Ge et al.

(10) Patent No.: US 7,598,921 B2
(45) Date of Patent: Oct. 6, 2009

(54) FOLDED ANTENNA

(75) Inventors: JunXiang Ge, Tokyo (JP); Shozaburo Kameda, Yokohama (JP); Hiroshi Ichikawa, Ube (JP)

(73) Assignees: Yokowo Co., Ltd., Tokyo (JP); UBE Industries, Ltd., Yamaguchi (JP)

( * ) Notice: Subject to any disclaimer, the term of this patent is extended or adjusted under 35 U.S.C. 154(b) by 560 days.

(21) Appl. No.: 10/593,714

(22) PCT Filed: Mar. 17, 2005

(86) PCT No.: PCT/JP2005/004793

§ 371 (c)(1),
(2), (4) Date: Sep. 21, 2006

(87) PCT Pub. No.: WO2005/091436

PCT Pub. Date: Sep. 29, 2005

(65) Prior Publication Data

US 2008/0238778 A1 Oct. 2, 2008

(30) Foreign Application Priority Data

Mar. 22, 2004 (JP) ..... 2004-083314

(51) Int. Cl.
*H01Q 9/16* (2006.01)
*H01Q 1/38* (2006.01)

(52) U.S. Cl. ..... 343/806; 343/700 MS

(58) Field of Classification Search ..... 343/700 MS, 343/702, 806, 846, 895
See application file for complete search history.

(56) References Cited

U.S. PATENT DOCUMENTS

| | | | | |
|---|---|---|---|---|
| 3,355,740 | A * | 11/1967 | Mayes | 343/792.5 |
| 4,286,271 | A * | 8/1981 | Barbano et al. | 343/792.5 |
| 6,674,405 | B2 * | 1/2004 | Wang | 343/700 MS |
| 6,693,604 | B2 * | 2/2004 | Washiro et al. | 343/895 |

FOREIGN PATENT DOCUMENTS

| | | |
|---|---|---|
| JP | 10-013135 | 1/1998 |
| JP | 11-168318 | 6/1999 |
| JP | 2002-314322 | 10/2002 |
| JP | 2003-069331 | 3/2003 |
| JP | 2003-124737 | 4/2003 |
| JP | 2003-218623 | 7/2003 |

* cited by examiner

*Primary Examiner*—Shih-Chao Chen
(74) *Attorney, Agent, or Firm*—Rabin & Berdo, P.C.

(57) ABSTRACT

An antenna element 1 is formed such that a plurality of turning parts 13, 15, 17 are formed by being turned back in zigzag in parallel to a ground conductor film 2 while extending perpendicularly thereto and the lengths of segments 12, 14, 16, 18 between the turning parts are shorter on a side of the ground conductor film 2 (a side of a feeding part 4) and increase gradually as the segments are away from the ground conductor film 2. The turning parts of the antenna element 1 are formed such that the antenna resonates at two or more frequency bands, and has a fractional bandwidth of 4% or more of its frequency in a first frequency band and a fractional bandwidth of 15% or more of its frequency in a second frequency band by adjusting the lengths $L_1$, $L_2$ and $L_3$ of respective segments and the intervals $d_1$, $d_2$ and $d_3$ between adjacent segments. Consequently, a wideband antenna is realized in two or more multi-frequency bands, for example 2.4 to 2.5 GHz and 5 to 6 GHz, by using a single folded antenna.

12 Claims, 6 Drawing Sheets

FOLDED ANTENNA

FIELD OF THE INVENTION

The present invention relates to an antenna suitable for use in, for example, wireless LANs (Local Area Networks) or the like, which can transmit and receive signals of two or more frequency bands, each of which has a wide bandwidth, a small size and a high function. More particularly, the present invention relates to a small-sized antenna which can operate at two frequency bands of, for example, 2.4 GHz and 5 GHz, and which still has a bandwidth of approximately 1 GHz at the frequency band of 5 GHz.

BACKGROUND OF THE INVENTION

In the prior art, a folded antenna 50, for example, shown in FIG. 10 has been introduced as an antenna suitable for transmitting and receiving signals of two or more frequency bands having approximately two times relationship (for example, cf. PATENT DOCUMENT 1). In the folded antenna 50, it is known that resonance at two or more frequency bands having approximately two times relationship can be achieved, since resonance frequencies can be adjusted by arranging intervals between adjacent segments 51, or the like. The antenna of this kind is formed on a surface of a cylindrical base made of, for example, dielectric materials or the like, mounted on a top part of a casing as an antenna for a portable telephone or the like, and used by setting the antenna element 51 located through a certain distance h to a ground face (a ground plate) 52 which is the casing of the portable telephone or the like.

PATENT DOCUMENT 1: Japanese Patent Application Laid-Open No. HEI10-13135

DISCLOSURE OF THE INVENTION

Problem to be Solved by the Present Invention

In the above-described folded antenna by the prior art, because a requirement of lowering a height of the antenna makes the distance (h in FIG. 10) between a bottom face of the antenna element 51 and the ground plate 52 small, an input impedance of the antenna at each frequency band can not be adjusted sufficiently and a bandwidth at each frequency band can not be widened sufficiently, even if resonance occurs at two frequency bands. Therefore, an antenna which has fractional bandwidths of 4.1% and 15.2% respectively at 2.4 GHz and 5 GHz bands demanded in 2.4 GHz and 5 GHz system in present wireless LANs can not be realized.

In the antenna of the above-described structure, since an input impedance of the antenna decreases and desired function can not be achieved in case that the distance h (cf. FIG. 10) between the bottom face of the antenna element 51 and the ground plate 52 is too small, it becomes necessary for the antenna element to be set apart from the casing in order to increase the distance. Thus, there occurs problems that down sizing of device can not be achieved and that adjusting impedances for both frequencies of two or more resonance frequency bands is difficult in case of the small distance h.

On the contrary, present wireless LANs, as mentioned above, require an antenna resonating at two frequency bands of 2.4 GHz and 5 GHz, and having a bandwidth of 100 MHz at the frequency of 2.4 GHz and a bandwidth of approximately 1 GHz at the frequency of 5 GHz, operating from 5 to 6 GHz.

The present invention is directed to solve the above-described problems and an object of the present invention is to provide a folded antenna to resonate at two or more frequency bands, for example such as 2.4 GHz and 5 GHz, and to widen a bandwidth to approximately 1 GHz, for example from 5 GHz to 6 GHz, only by a single antenna.

Another object of the present invention is to provide a folded antenna of a structure in which a desired impedance or a desired resonance frequency can be obtained only by adjusting turning parts, widths of segments and intervals between segments, with less influence caused by a relationship to the ground plate in adjusting the impedance.

Means for Solving the Problem

The present inventors have studied earnestly to develop an antenna, for use in present wireless LANs as described above, which can be used at two frequency bands of 2.4 GHz and 5 GHz which has a bandwidth from 5 to 6 GHz. The antenna, which satisfies the above-described conditions required in the wireless LANs, has been consequently realized, by a structure where an antenna element is turned back in a direction parallel to one face of a ground plate (a direction perpendicular to a direction in which the antenna element mainly extends), or in a direction parallel to a ground conductor film (the ground plate) which is perpendicular to the antenna element on a side of a feeding part, and the lengths of the segments parallel to the ground conductor film increase as the segments are away from the feeding part, wherein resonance frequencies can be adjusted by arranging the lengths of the segments between each turning part and intervals between adjacent segments, resonance can be nearly obtained in a range between the two resonance frequencies by setting them closely each other in high resonance frequencies, and a wide bandwidth of approximately 1 GHz can be achieved as a result.

A folded antenna according to the present invention includes; a ground plate, and an antenna element having a plurality of turning parts and a plurality of segments formed between the turning parts, the segments being formed by being turned back in zigzag in parallel to one face of the ground plate at the turning parts, while the antenna element extending perpendicularly to the one face of the ground plate, wherein a length of one segment or a length of a set of segments, which is a pair of arbitrary two adjacent segments having the same length, is shorter on a side of the one face of the ground plate and increase gradually as the segment or the set of segments is away from the one face of the ground plate, and wherein the antenna element is formed such that the folded antenna resonates at two or more frequency bands and has a fractional bandwidth of 4% or more of a frequency in a first frequency band and a fractional bandwidth of 15% or more of a frequency in a second frequency band, by adjusting lengths of the segments or sets of segments having the same length, and intervals between adjacent segments. Here, the fractional bandwidth means a ratio ($\Delta f/f_0$) of a bandwidth ($\Delta f$) to a center frequency ($f_0$).

Here, the one face of the ground plate means a principal face or an end face of the ground plate, nearest a feeding part of the antenna, for example a face in a direction of a thickness of the ground conductor film at an end part of the ground conductor film nearest the feeding part of the antenna element in case that the antenna element and the ground plate (the ground conductor film) are formed of a conductor film, side by side, on a surface of a dielectric substrate.

By forming three or more segments such that at least two of intervals between two adjacent segments among the segments are different, adjustment of resonance frequencies can be easy.

More concretely, the folded antenna according to the present invention may further include: a dielectric base, on a dielectric face, that is, a surface or an inside face of which the antenna element is formed by a conductor film; a ground conductor film to be connected to ground as the one face of the ground plate, the ground conductor film being provided on a side surface of the dielectric base which is perpendicular to the dielectric face; and an end part of the antenna element which is provided on the side surface so as not to contact to the ground conductor film; wherein the antenna element is extended in a direction perpendicular to the side surface from the end part on the dielectric face, and then turned so as to be in parallel to one side which is a cross line of the side surface and the dielectric face, and this construction is repeated such that a plurality of turning parts are formed in a direction away from the side surface.

Further concretely, a distance between a first segment, which is nearest the ground conductor film among segments parallel to the one side, and the ground conductor film is from 0.8 to 1 mm, a length of the first segment is from 4 to 4.5 mm, the lengths of the segments are set so as to increase gradually as the segments are away from the ground conductor film, by a ratio from 1.05 to 2, which is a ratio of the length of adjacent segments or adjacent a segment and a set of segments parallel to the one side surface.

And the turning parts may be formed so as to spread symmetrically at a same angle for both sides of the center line which is defined as an extension of the end part of the antenna element perpendicularly to the one face of the ground plate, or the turning parts of one side are formed on the center line or a line apart from the center line by a certain distance and parallel to it and the turning parts of another side are formed to spread to only one direction as to the center line, in order.

By forming the ground conductor film so as to extend to the dielectric face of the dielectric base, for example, influence by other parts located on a circuit board or by users hand of portable telephones can be reduced.

Effect of the Invention

The structure according to the present invention gives a small influence to an input impedance of the antenna because of a small capacitance between the ground plate and the antenna element, since the segments of the antenna element are short near the ground plate, and increase in length as the segments are away from the ground plate. And as explained later, since a resonance frequency can be adjusted by changing the lengths of the segments in order, a low frequency band can be set closely to a desired frequency, and, simultaneously, two resonance frequencies in high frequency can also be set very near, and the range between two resonance frequencies can be treated as one resonance in a high frequency band.

As a result, the impedance can be prevented from lowering related to the ground plate, and an antenna which resonates at a desired frequency band with a desired bandwidth can be realized. Moreover, there can be obtained an antenna which transmits and receives signals of two frequency bands with wide bandwidths by a single antenna at high frequency bands apart from each other, for example, from 2.4 to 2.5 GHz and from 5 to 6 GHz employed in present LANs.

EXPLANATION OF LETTERS AND NUMERALS

Figure 1A:
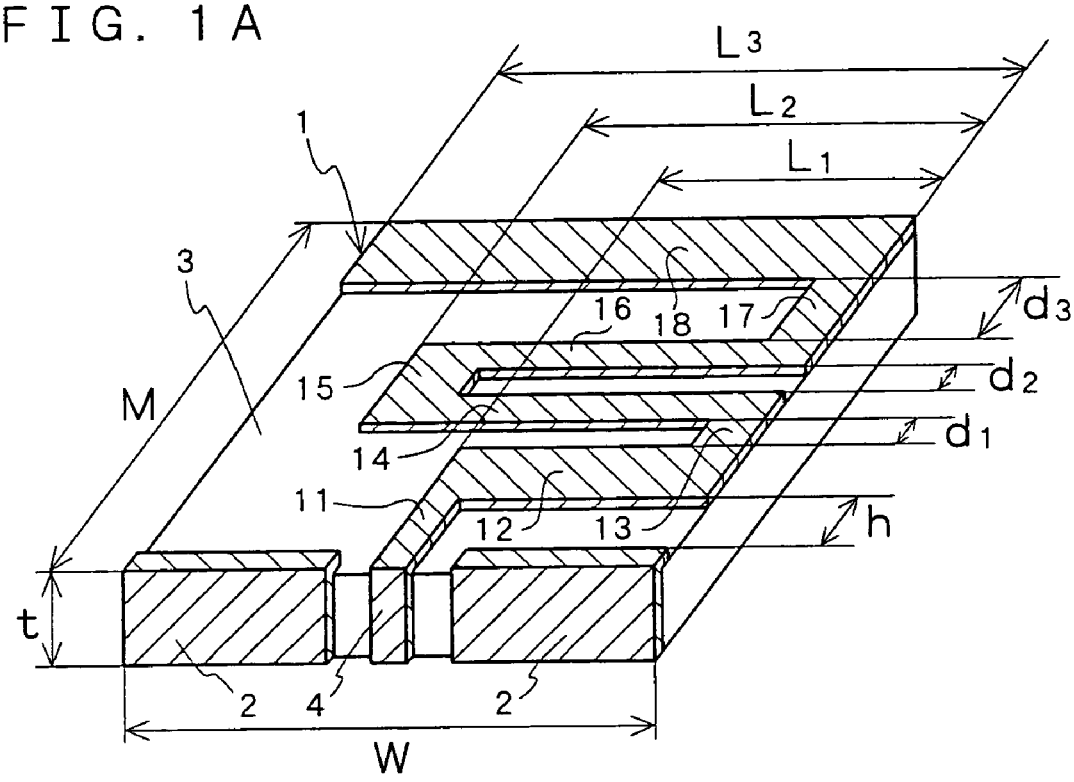
FIGS. 1A and 1B are an explanatory figure of an embodiment of the antenna according to the present invention and an explanatory figure of the same mounted on a substrate.

1: antenna element
2: ground plate (ground conductor film)
3: dielectric base
4: feeding part

THE BEST EMBODIMENT OF THE PRESENT INVENTION

A description will be given below of a folded antenna according to the present invention in reference to the drawings. As shown in an explanatory perspective view of an embodiment in FIG. 1A, the folded antenna according to the present invention includes a ground plate 2 and an antenna element 1 having a plurality of turning parts 13, 15, 17 and a plurality of segments (a first segment 12, a set of a second segment 14 and a third segment 16, and a forth segment 18) formed between the turning parts. The segments are formed by turning back the antenna element in zigzag in parallel to one face of the ground plate 2 at the turning parts, while the antenna element generally extending perpendicularly to the one face of the ground plate 2. A length of one segment or a length of a set of segments, which is a pair of arbitrary two adjacent segments having the same length, is shorter on a side of the one face of the ground plate 2 (feeding part 4) and increase gradually as the segment or the set of segments is away from the one face of the ground plate 2. In a relationship between the lengths of two adjacent segments, two adjacent segments 14 and 16 of the same length are treated as one set of segments combined in one pair. Further in the present invention, the antenna element is formed such that the folded antenna resonates at two or more frequency bands and has a fractional bandwidth of 4% or more of a frequency in a first frequency band and a fractional bandwidth of 15% or more of a frequency in a second frequency band, by adjusting each of lengths $L_1$, $L_2$ and $L_3$ of the segments 12, 14, 16 and 18, and intervals $d_1$, $d_2$ and $d_3$ between adjacent segments.

An example shown in FIG. 1 is an antenna for wireless LANs used at two frequency bands of 2.4 to 2.5 GHz and of 5 to 6 GHz, in which the antenna element 1 is formed on a surface of a dielectric base 3 made of ceramic having a relative dielectric constant of 20 having a size represented as length(M)×width(W)×thickness(t) are 7 mm×8 mm×0.9 mm.

In place of forming the antenna element 1 on the surface of the dielectric base 3 as shown in FIG. 1, there can be employed following manners of, for example, forming a part or all of the antenna element on a surface of a dielectric film and laminating it on other dielectric film and sintering, forming a part or all of the antenna element inside the dielectric base 3 by sticking a dielectric substrate, forming the antenna element folded in the air, forming the antenna element on a surface of a dielectric base shaped in cylinder or in column, and forming the antenna element on a flexible dielectric film and rounding it in a cylinder shape. The point is to turn back the antenna element in order to obtain a desired bandwidth at a desired frequency band, in such manner that the antenna element 1 is turned back plural times in a direction parallel to the one face of the ground plate 2 (a direction perpendicular to a direction in which the antenna element generally extends), and that the length of the segment parallel to the ground plate 2 increases as the segment is away from the ground plate 2.

The antenna element 1 can be formed by patterning a conductor film formed on a ceramic substrate or the like by sputtering technique as described above, by forming a desired pattern by screen printing technique, or by folding metal wire like cable materials. According to the present invention, the antenna element 1 is characterized in that the lengths $L_1$, $L_2$, $L_3$ of the segments between the turning parts are shorter on the side of the ground conductor film 2 of the ground plate and increase as the segments are away from, and that the antenna can be used at 2.4 to 2.5 GHz and 5 to 6 GHz by adjusting to resonate in a range from f3 to f4 by setting resonance frequencies of f3 and f4 closely each other and adjusting its resonance frequency to approximately two times of f1, by adjusting a plurality of resonance frequencies of f1, f2, f3, f4, by arranging each length $L_1$, $L_2$, $L_3$ and each interval $d_1$, $d_2$, $d_3$ of the segments, furthermore each width of the segments.

In a usual antenna, for example, an antenna having a length of ¼ wavelength tends to become an antenna having a length of ¾ wavelength for a frequency of three times, and it is easy to get resonance at frequencies of odd times like 3, 5, 7 times. On the other hand, it is well known that resonance can be obtained at a frequency band of two times by using a folded antenna, as described later. The present inventors have found, by further adjustment of the folded antenna as described above, that, for example, by setting f3 and f4 among arbitrary resonance frequencies f1, f2, f3, f4 very closely, an interval between them can be recognized as one frequency band of resonance.

Figure 3A:
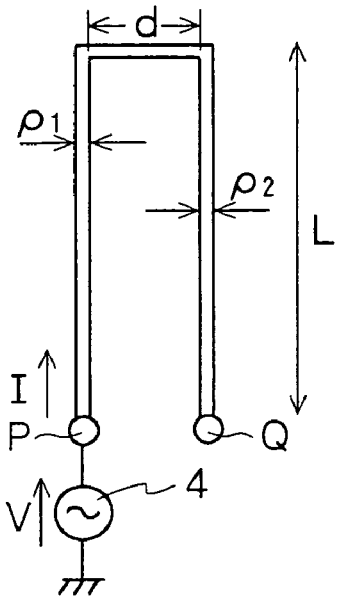
FIGS. 3A through 3E are figures explaining that an impedance or a frequency of the folded antenna shown in FIG. 1 can be changed.
Figure 3B:
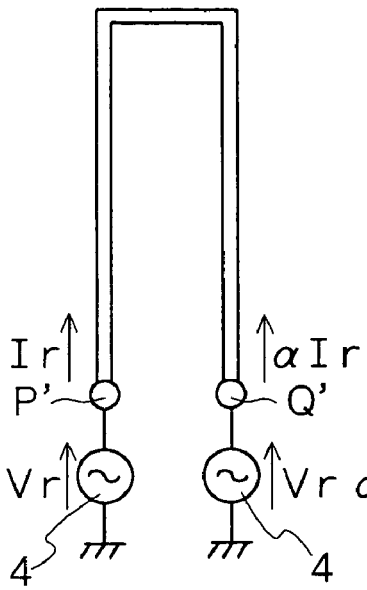
Figure 3C:
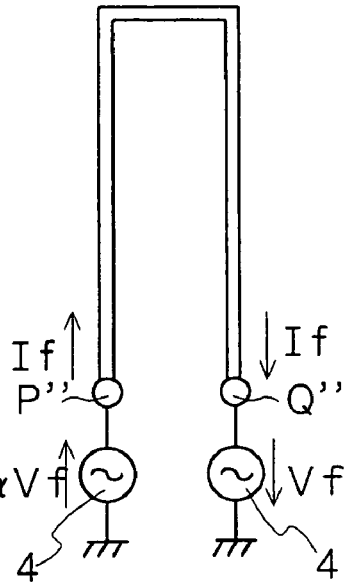

The folded antenna, for example, shown in FIG. 3A, having a length of L, widths of ρ1 and ρ2 and an interval of d, is understood by dividing into an even mode of currents Ir of both segments flowing in a same direction, as shown in FIG. 3B, and an odd mode of currents If flowing in a reverse direction, as shown in FIG. 3C. The even mode and the odd mode shown in FIGS. 3B and 3C can be replaced by equivalent circuits shown in FIGS. 3D and 3E, respectively by simplifying with communizing the feeding part 4. And in FIGS. 3A through 3E, I represents a current fed to the folded antenna, V a voltage fed to the folded antenna, Ir a current fed to segments of the even mode in case of dividing into the even mode and the odd mode, If a current fed in odd mode and V a feeding voltage respectively. An α is a factor relating to a coupling of turning parts represented by equation (2) described later.

Figure 3D:
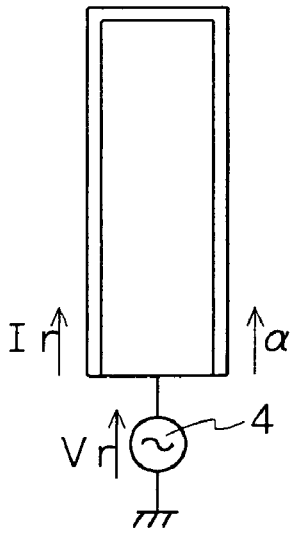

According to FIG. 3D, an input impedance Zr of the antenna in the even mode is represented by next equation (1).

$$Zr=V/\{(1+\alpha)^2 Ir)\} \tag{1}$$

Here, α is represented as next equation (2).

$$\alpha = \frac{\cosh^{-1}\dfrac{\gamma^2-\mu^2+1}{2\gamma}}{\cosh^{-1}\dfrac{\gamma^2+\mu^2-1}{2\gamma\cdot\mu}} \tag{2}$$

Here, γ=d/ρ1, μ=ρ2/ρ1, and L is an electrical length of the entire antenna element 1 turned back.

Figure 3E:
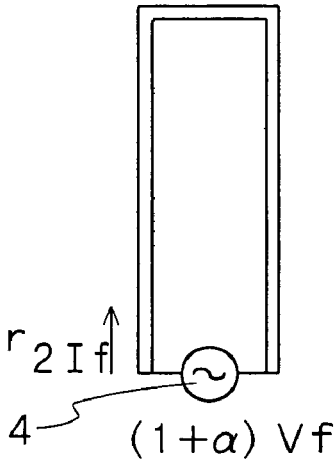

And an input impedance Zf in the odd mode is represented by next equation (3), obviously from FIG. 3E.

$$Zf=V/(2If)=jZ_0\tan(kL) \tag{3}$$

Here, k=2π/λ, λ represents a wavelength, and $Z_0$ represents a characteristic resistance of parallel wires (Lecher wires).

By using equations (1) and (3), an input impedance of the folded antenna is represented by next equation (4).

$$Zin = \frac{\alpha(1+\alpha)^2 Zr\cdot Zf}{(1+\alpha)^2 Zr + 2Zf} \tag{4}$$

In equation (3), kL=2πL/λ has an approximately constant value because the resonance frequency, or the wavelength λ, is varied with variation of the electrical length L by turning back. As a result, the input impedance of equation (3) and equation (1) has an approximately constant value even if the resonance frequency varies, although α, that is the width ρ of the antenna or the distance d between the turning parts varies, and the impedance of equation (4) has a wide band to the resonance frequency.

In such manner, by adjusting the lengths of segments (turning back) and the distances between segments (turning back) or the like, and by forming the antenna of the structure shown in FIG. 1, for example by setting f3 and f4 among f1 through f4 very closely each other, f1 can be from 2.4 to 2.5 GHz and f3 to f4 can be from 5 to 6 GHz. A return loss to the frequency of the antenna is shown in FIG. 2A and the return loss to the frequency of the antenna in case that the length of each segment is not varied, or in case of turning back by a constant length, is shown comparatively in FIG. 2B. Obviously from FIG. 2, the desired resonance frequencies of 2.4 to 2.5 GHz and 5 to 6 GHz can be obtained by the folded antenna in which the lengths of the segments increase gradually, but the resonance frequency of 5 to 6 GHz can not be obtained by the antenna in which the segments have same length.

Figure 10:
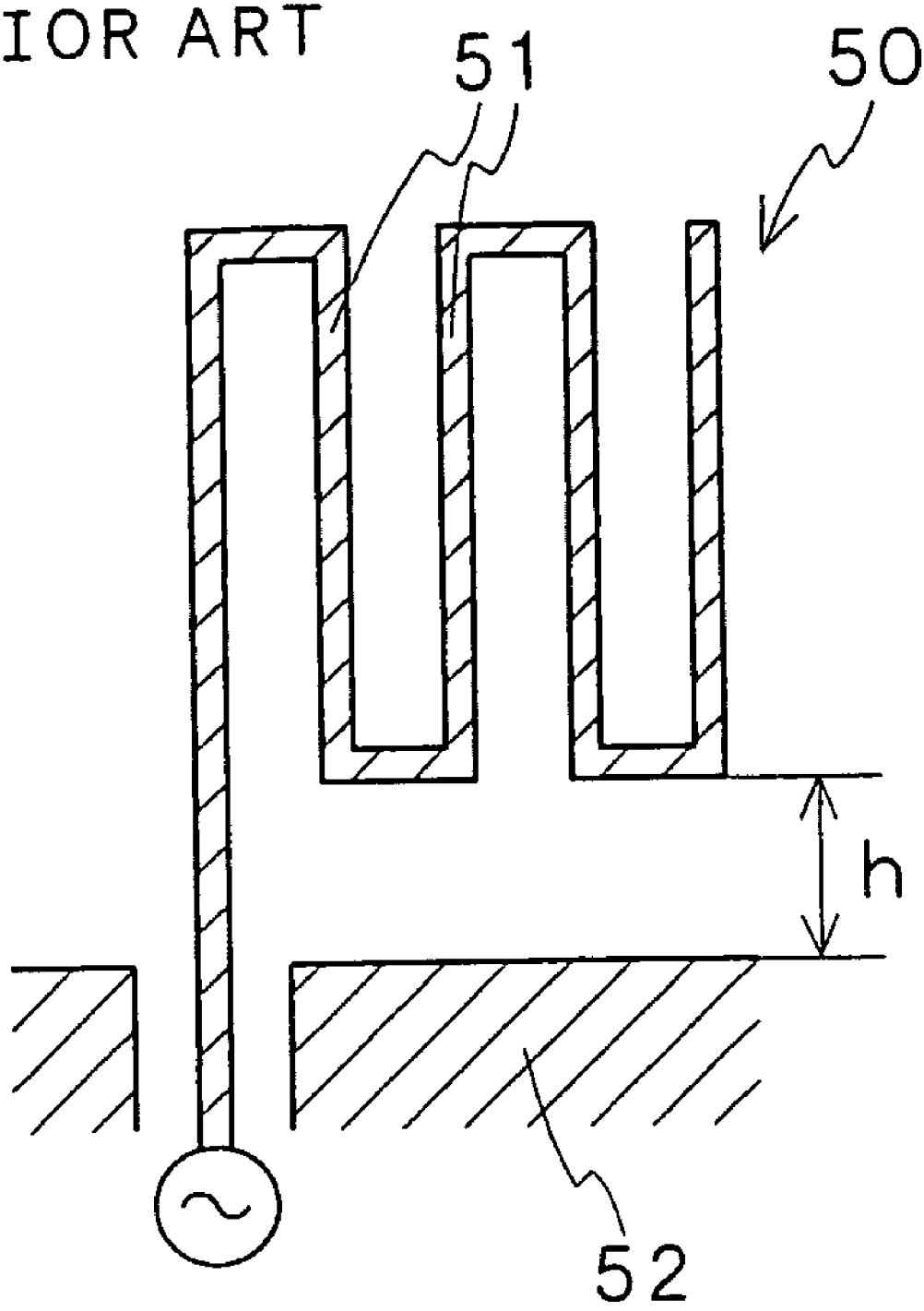
FIG. 10 PRIOR ART
FIG. 10 is a figure showing an example of a structure of the folded antenna by the prior art.

Values of each dimension in the antenna corresponding to FIG. 1 in the above-described case are $L_1$=4 mm, $L_2$=6 mm, $L_3$=8 mm, $d_1$=0.6 mm, $d_2$=0.7 mm, $d_3$=0.8 mm, h=0.8 mm, the width of the segment 12 is 1 mm, the width of the segment 14 and 16 is 0.8 mm and the width of the segment 18 is 1 mm. Since the length $L_1$ of the first segment 12 is small, the distance h from the ground conductor film 2 can be reduced to approximately 0.8 to 1 mm from 2 to 3 mm of that of the conventional structure shown in FIG. 10. A relationship between the lengths of two adjacent segments which gradually increase, is not limited to the above-described example, and the relationship between the lengths of two adjacent segments can be adjusted from 1.05 to 2 times, for example 1.5 times, such that a desired bandwidth at a desired frequency and a desired impedance are obtained.

As described in the above example, adjusting of the frequencies becomes easy by forming the intervals between the segments to be not same but different, and adjusting the resonance frequency becomes also easy by varying the widths of the segments further. In other words, adjustments to get the relationship of the frequency described above and the desired impedance are performed not only by turning back the antenna element simply but also by increasing gradually the lengths of the segments between the turning parts as the segments are away from the ground plate and by varying the widths of the segments and the intervals between two adjacent segments by two or more different values. Here, once the dimensions of the antenna element having the desired characteristics are designed, mass production is capable by producing by using the same dimensions. And in the example shown in FIG. 1, the ground conductor film 2 is extended on the surface of the dielectric base 3 but it can be allowed to be formed only on the side surface (a bottom surface).

In the folded antenna according to the present invention, the antenna element is formed not only by turning back simply but also by turning back so that the segments formed by turning back are parallel to the one face of the ground plate (the ground conductor 2) provided on the side of the feeding part 4 (perpendicular to the direction in which the antenna element extending mainly) and that the lengths of $L_1$ to $L_3$ of each segment increase in order. As a result, a capacitance between the ground plate and the segment can be reduced, the input impedance can be prevented from reducing and the desired impedance can be obtained by adjusting the intervals between the segments or the like. And the resonance frequency f1 to f4 can be adjusted by adjusting the lengths of the segments and the intervals between segments. As shown in FIG. 2A described above, an antenna has been developed which resonates at f1 of a frequency of 2.4 to 2.5 GHz (a fractional bandwidth of approximately 4%), and resonates at a frequency of 5 GHz with a bandwidth of approximately 1 GHz (a fractional bandwidth of approximately 18%) by setting f3 and f4 very closely.

Figure 1B:
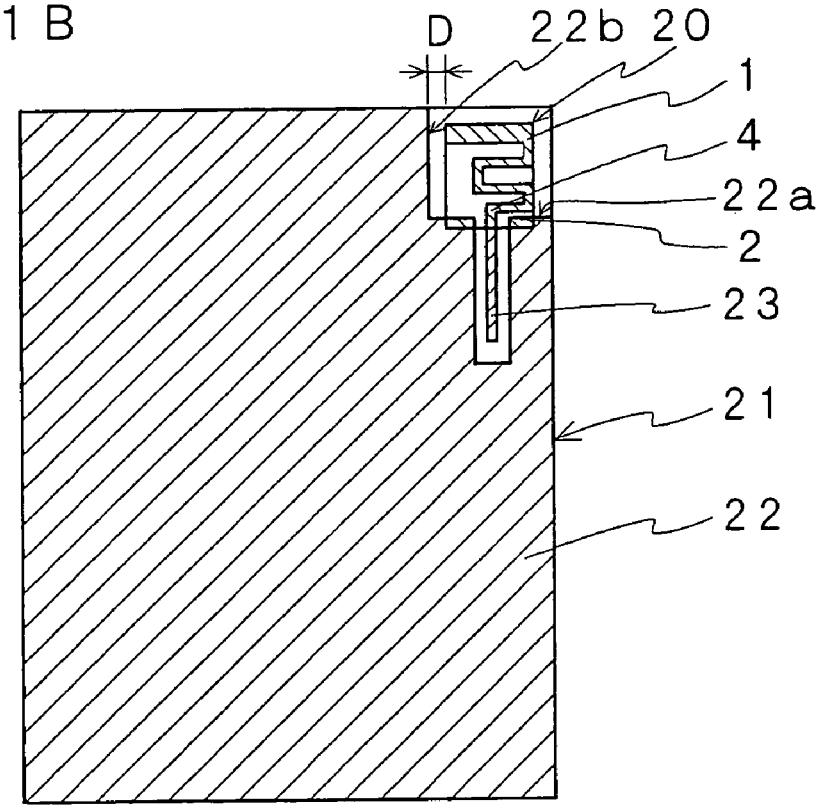
Figure 2A:
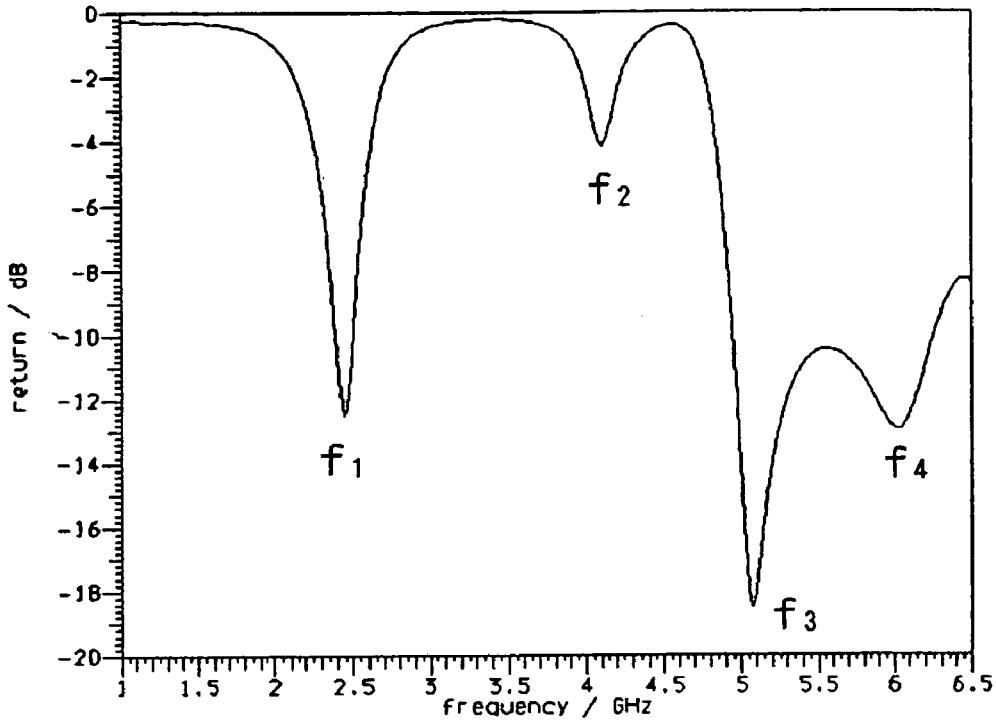
FIGS. 2A and 2B are graphs showing characteristics of a return loss to a frequency in the antenna shown in FIG. 1, compared to that in a folded antenna having same length of segments.
Figure 2B:
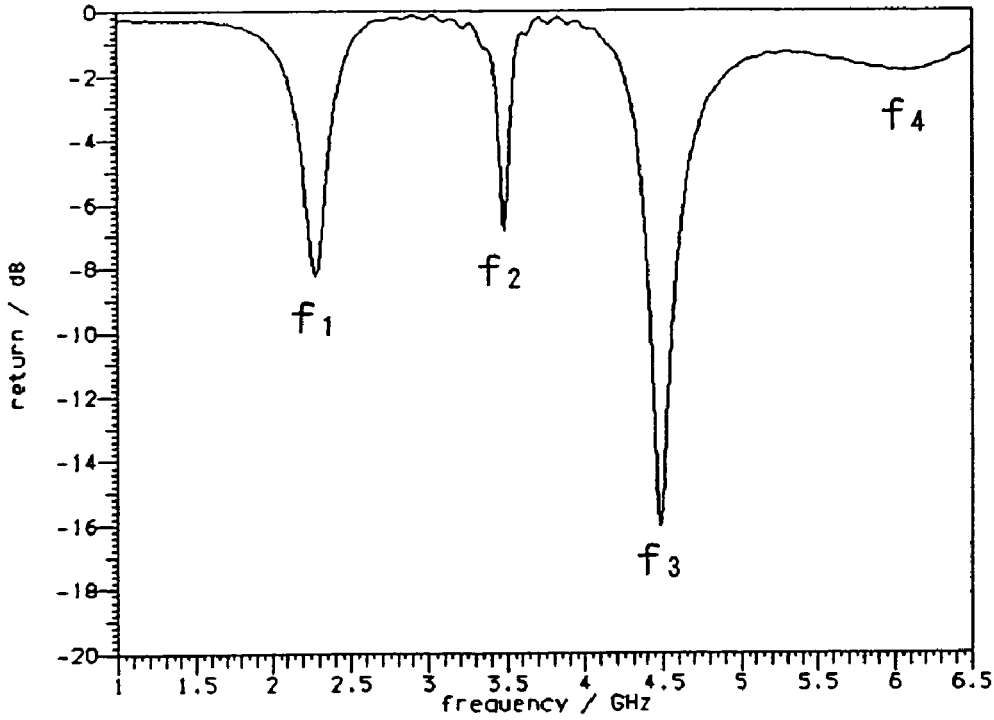

The antenna 20 described above is mounted on a substrate 21 loaded in wireless LANs or portable telephones as shown in FIG. 1B. In FIG. 1B, except mounting part of the antenna and the feeding wiring 23, a ground conductor 22 is formed and connected to the ground conductor film 2 of the antenna 20. The feeding wiring 23 is connected to the feeding part 4 of the antenna 20 and its another end part is leaded to the surface of the substrate 21 and connected to the transmitting and receiving circuit formed on the surface. As shown in this example, by forming the ground conductor 22*b* on the side face of the antenna 20, by adjusting a distance D, an impedance of the antenna 20 can be further adjusted.

And in this structure, at the relationship between the direction of extending antenna element and the one face of the ground plate, the one face of the ground plate corresponds still to the ground conductor film 2 formed on the side surface of the dielectric base 3. On the contrary, in case that the antenna element 1 and the ground conductor film 22 or the like are not formed independently but formed directly on a dielectric substrate as shown in FIG. 1B, the one face in the relationship between the direction of extending antenna element and the one face of the ground plate, means a face in a direction of thickness of the ground conductor film 22 (perpendicular to the paper) at an end face 22*a* of the ground conductor film 22 nearest the feeding part 4.

Figure 4:
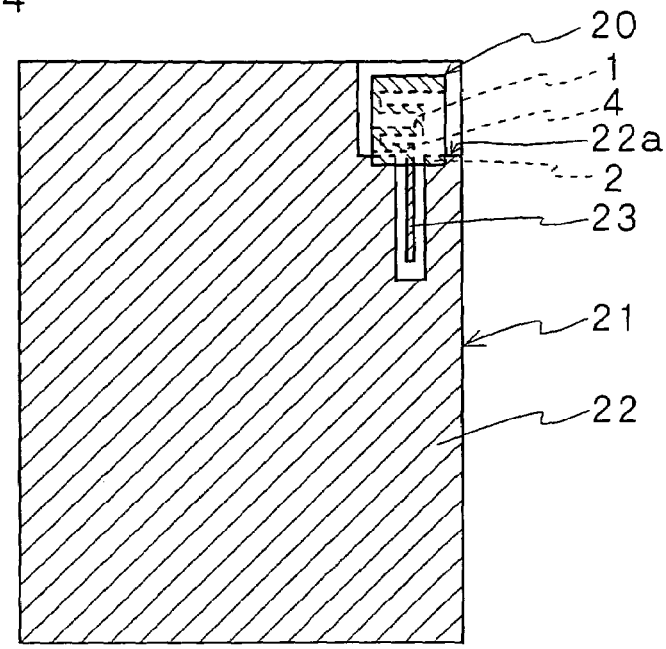
FIG. 4 is a figure showing another example as shown in FIG. 1B, in which the antenna is mounted upside down on a substrate.

And in case that the antenna is mounted in a substrate of wireless LANs, the antenna can be mounted so as to turn a face, on which the antenna 1 is formed, to a side of the substrate 21 as shown in FIG. 4, in place that the antenna 20 is mounted such that the face on which the antenna is formed is outside as shown in FIG. 1B. And in FIG. 4, same numerals are employed for same parts as those in FIG. 1 and explanations are omitted.

Figure 5A:
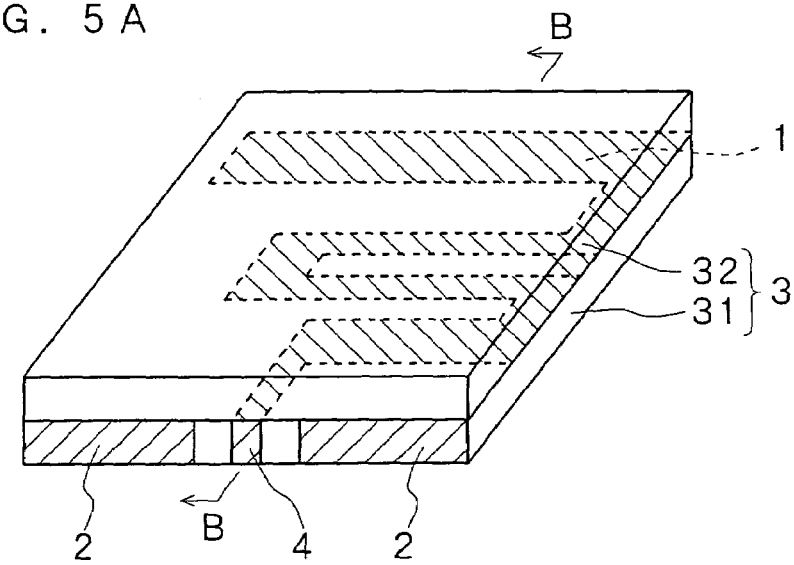
FIGS. 5A and 5B are figures showing an example of the antenna element embedded in the dielectric base.
Figure 5B:
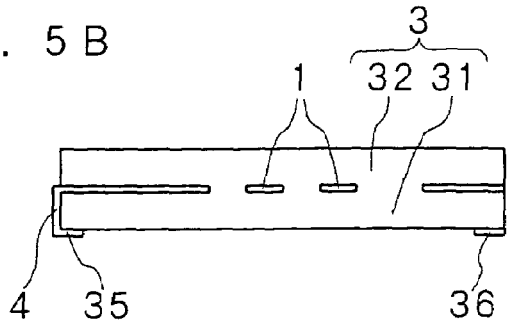

Furthermore, the antenna 20 can be formed inside the dielectric base 3 as shown in FIGS. 5A and 5B which are a perspective view and an explanatory B-B' cross section, in place that the antenna 1 is exposed at a top face in FIG. 1B. The antenna of this type can be formed by steps of, for example, forming a plurality of the antenna elements 1 described above on a surface of a first ceramic sheet 31 of wide sheet, laminating a second ceramic sheet 32 on it, dividing into each antenna and sintering, forming the feeding part 4 and the ground conductor 2 made of a conductor film on an end part of the antenna 1 by painting conductor paste, and sintering. Even in this structure, the antenna element 1 extends in a direction perpendicular to the one face of the ground conductor 2, and satisfies the relationship described above. And in FIGS. 5A and 5B, member 35 and 36 are formed as lands which are formed on a back face of the ceramic sheet 31 for soldering to the substrate 21 or the like.

In a manner of forming the antenna elements inside the ceramic base 3, productivity is raised remarkably because many of antenna elements can be formed by printing in a wide ceramic sheet which can be scribed and sintered.

In the example shown in FIG. 1, the pattern is formed so that the segments of different lengths are formed for the other side opposite as to a parallel line (an end face of the ceramic base 3) at a constant distance from the center line of the segment 11 extending perpendicular to the ground conductor film 2 on the side of the feeding part 4 (an end part of an antenna element 1). However, at least in the structure where the lengths of the segments increase gradually (same length is allowed) as the segments are away from the ground plate, the antenna which have desired bandwidths at desired frequency bands of the first and the second can be obtained by adjusting the lengths, the widths and the intervals of the segments. Patterns of this kind are shown below.

Figure 6:
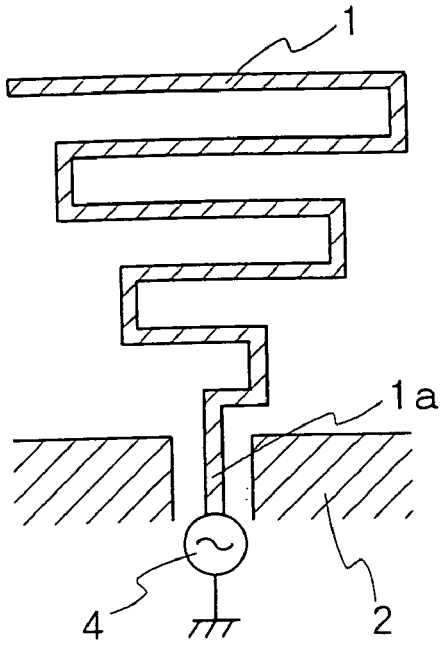
FIG. 6 is a figure showing an example of other pattern of the folded antenna.

An example shown in FIG. 6 is an antenna in which the segments are turned back symmetrically as to a center line of an axis of the segment 1*a* (the axis perpendicular to the ground plate 2) connected to the feeding part 4 and increase gradually. In this shape, the antenna element can be formed on a ceramic substrate, inside a dielectric base by laminating dielectric sheets or by a simple metal wire. In such case of symmetry, adjusting resonance frequency can be performed easily.

Figure 7:
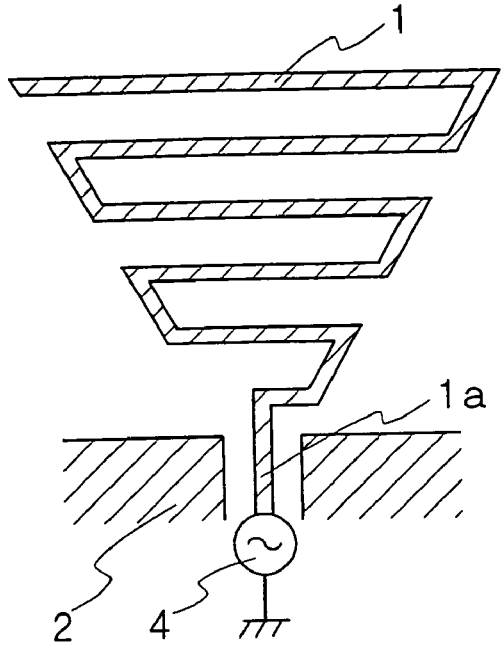
FIG. 7 is a figure showing an example of other pattern of the folded antenna.

An example shown in FIG. 7 is same type as the example shown in FIG. 6, but in this example, turning part is not perpendicular to the segments parallel to the ground plate 2, but oblique, and the other structure is same as that shown in FIG. 6. By turning back oblique, an antenna of a wider bandwidth can be easily obtained.

Figure 8:
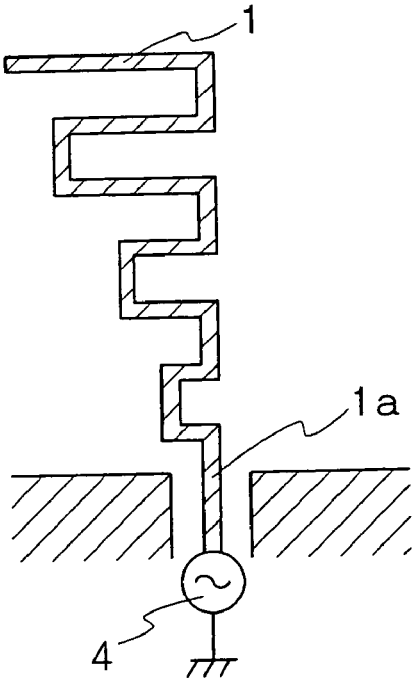
FIG. 8 is a figure showing an example of other pattern of the folded antenna.

In an example shown in FIG. 8, the antenna element is turned back to only one side (left side in FIG. 8) as to an axis of the segment 1*a* connected to the feeding part 4, and the lengths of the segments between the turning parts increase gradually. In other words, the base line of the turning parts in FIG. 1A, is a center line of the segment 1*a* connected to the feeding part 4, and the other structure is same as that shown in FIG. 1. It is a merit of this type to obtain an antenna of wide bandwidth easily.

Figure 9:
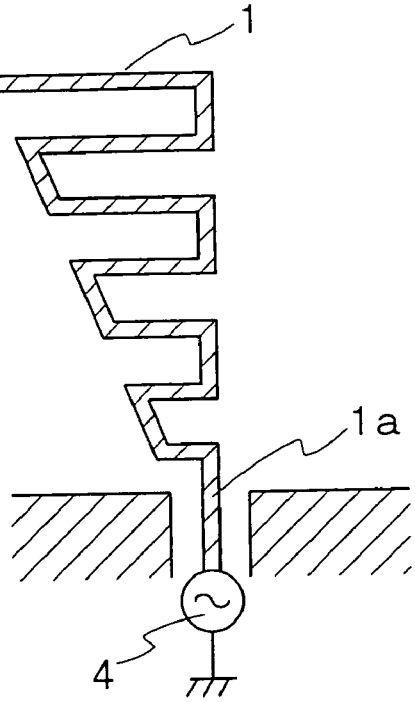
FIG. 9 is a figure showing an example of other pattern of the folded antenna.

An example shown in FIG. 9 is the antenna element in which turning parts in the structure shown in FIG. 8 are formed oblique, same as the example shown in FIG. 7. Turning back like this has merits of examples shown in FIGS. 7 and 8.

The above-described example is an antenna of two frequency bands of 2.4 GHz and 5 GHz, but frequency bands are not limited to these, and this structure is effective to get resonance at two or more frequency bands, having a resonance characteristics of a wide bandwidth specially at a high frequency, only by a single antenna.

INDUSTRIAL APPLICABILITY

The antenna according to the present invention can be employed for wireless LANs, portable telephones, Zig Bee (a standard for short-distance wireless communications for home electrical appliances, technology of same kind as Bluetooth) or the like.

What is claimed is:

1. A folded antenna comprising:

a ground plate; and an antenna element having a plurality of turning parts and a plurality of segments formed between the turning parts, the segments being formed by being turned back in a zigzag manner in parallel to one face of the ground plate at the turning parts, the antenna element extending perpendicularly to the one face of the ground plate, with one end connected to a feeding part and the other end open, wherein a length of one segment or a length of a set of segments, which is a pair of arbitrary two adjacent segments having the same length, is shorter on a side of the one face of the ground plate and increases gradually as the segment or the set of segments is away from the one face of the ground plate, and wherein the antenna element is formed such that the folded antenna resonates at two or more frequency bands and has a fractional bandwidth of 4% or more of the resonance frequency in a first frequency band and a fractional bandwidth of 15% or more of the resonance frequency in a second frequency band, by adjusting lengths of the segments or sets of segments having the same length, and intervals between adjacent segments, and a face opposed to the antenna element is free of any ground conductor.

2. The folded antenna according to claim 1, wherein three or more segments are formed such that at least two of intervals between two adjacent segments among the segments are different.

3. The folded antenna according to claim 1, wherein the first frequency band is from 2.4 to 2.5 GHz and the second frequency band is from 5 to 6 GHz.

4. The folded antenna according to claim 1, further comprising:

a dielectric base, on a dielectric face, that is, a surface or an inside face of which the antenna element is formed by a conductor film;

a ground conductor film to be connected to ground as the one face of the ground plate, the ground conductor film being provided on a side surface of the dielectric base which is perpendicular to the dielectric face; and an end part of the antenna element which is provided on the side surface so as not to contact to the ground conductor film;

wherein the antenna element is extended in a direction perpendicular to the side surface from the end part on the dielectric face, and then turned so as to be in parallel to one side which is a cross line of the side surface and the dielectric face, and this construction is repeated such that the plurality of turning parts are formed in a direction away from the side surface.

5. The folded antenna according to claim 4, wherein a distance between a first segment, which is nearest the ground conductor film among segments parallel to the one side, and the ground conductor film is from 0.8 to 1 mm, a length of the first segment is from 4 to 4.5 mm, the lengths of the segments are set so as to increase gradually as the segments are away from the ground conductor film, by a ratio from 1.05 to 2, which is a ratio of the length of adjacent segments or adjacent a segment and a set of segments parallel to the one side surface.

6. The folded antenna according to claim 4, wherein the turning parts are bended obliquely.

7. The folded antenna according to claim 4, wherein the ground conductor film is formed so as to extend to the dielectric face of the dielectric base.

8. The folded antenna according to claim 4, wherein the dielectric base is stuck on a back face of a circuit board, on a surface of which a transmitting and receiving circuit is formed, and on the back face of which a metal film is provided surroundings the dielectric base and a part of a feeding line to be connected to the end part of the antenna element, and the metal film and the ground conductor film are electrically connected.

9. The folded antenna according to claim 1, wherein the turning parts are formed so as to spread symmetrically at a same angle for both sides of the center line which is defined as an extension of the end part of the antenna element perpendicularly to the one face of the ground plate, or the turning parts of one side are formed on the center line or a line apart from the center line by a certain distance and parallel to it and the turning parts of another side are formed to spread to only one direction as to the center line, in order.

10. The folded antenna according to claim 1, wherein two or more segments are formed such that at least two of widths of the segments among the segments are different.

11. A folded antenna comprising:

a dielectric base;

a ground conductor film which is provided on at least a part of one surface of the dielectric base as a ground plate; and an antenna element having a plurality of turning parts and a plurality of segments formed between the turning parts, the segments being formed by being turned back in a zigzag manner in parallel to an end face of the ground conductor film at the turning parts, the antenna element extending perpendicularly to the end face of the ground conductor film, wherein a length of one segment or a length of a set of segments, which is a pair of arbitrary two adjacent segments having the same length, is shorter on a side of the ground conductor film and increases gradually as the segment or the set of segments is away from the ground conductor film, and wherein the antenna element is formed such that the folded antenna resonates at two or more frequency bands and has a fractional bandwidth of 4% or more of a frequency in a first frequency band and a fractional bandwidth of 15% or more of a frequency in a second frequency band, by adjusting lengths of the segments or sets of segments having the same length, and intervals between adjacent segments, and a face opposed to the antenna element is free of any ground conductor.

12. The folded antenna according to claim 11, wherein the dielectric base is provided on a part of a back face of a circuit board, on a surface of which a transmitting and receiving circuit is formed, and on the back face of which a metal film is provided surroundings the antenna element and a part of a feeding line to be connected to the end part of the antenna element, and the metal film and the ground conductor film are electrically connected.

* * * * *

UNITED STATES PATENT AND TRADEMARK OFFICE

CERTIFICATE OF CORRECTION

PATENT NO. : 7,598,921 B2
APPLICATION NO. : 10/593714
DATED : October 6, 2009
INVENTOR(S) : Ge et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 575 days.

Signed and Sealed this

Twenty-eighth Day of September, 2010

David J. Kappos

David J. Kappos
*Director of the United States Patent and Trademark Office*